US010113765B1

(12) United States Patent
May et al.

(10) Patent No.: US 10,113,765 B1
(45) Date of Patent: Oct. 30, 2018

(54) REMOTE CONTROLLED VENT REGISTER

(71) Applicants: Matthew Ryan May, Katy, TX (US); Swearingen Mark Ryan, Houston, TX (US); Ronald Graczyk, Cedar Park, TX (US); Wilhelm C. Benker, Austin, TX (US)

(72) Inventors: Matthew Ryan May, Katy, TX (US); Swearingen Mark Ryan, Houston, TX (US); Ronald Graczyk, Cedar Park, TX (US); Wilhelm C. Benker, Austin, TX (US)

(73) Assignee: Matthew Ryan May, Fulshear, TX (US)

( * ) Notice: Subject to any disclaimer, the term of this patent is extended or adjusted under 35 U.S.C. 154(b) by 927 days.

(21) Appl. No.: 14/245,733

(22) Filed: Apr. 4, 2014

Related U.S. Application Data

(63) Continuation-in-part of application No. 13/644,142, filed on Oct. 3, 2012, now abandoned.

(60) Provisional application No. 61/542,652, filed on Oct. 3, 2011.

(51) Int. Cl.
*F24F 11/74* (2018.01)

(52) U.S. Cl.
CPC ..... *F24F 11/74* (2018.01)

(58) Field of Classification Search
CPC ..... F24F 11/04; F24F 13/1426; F24F 13/065; F24F 2013/1446; F24F 2013/1433; F24F 2013/1473; F24F 11/74; B60H 1/3428; B60H 1/3435; B60H 1/3442
See application file for complete search history.

(56) References Cited

U.S. PATENT DOCUMENTS 2,067,575 A * 1/1937 Meyerhoefer ..... F28D 1/024 165/99
2,104,279 A * 1/1938 Sperry ..... B60H 1/3414 454/155
2,293,065 A * 8/1942 Kiczales ..... F24F 13/15 454/335
5,129,859 A * 7/1992 Yagi ..... B60H 1/00871 137/875
6,176,775 B1 * 1/2001 Volk ..... B60H 1/3414 454/154
8,602,852 B2 * 12/2013 Sawada ..... B60H 1/3428 454/143

(Continued)

FOREIGN PATENT DOCUMENTS

DE 102005035768 A1 * 2/2006 ..... B60H 1/34

OTHER PUBLICATIONS www.google.com/search?q=rv+ac+vents (8 pages) (May 30, 2013).

*Primary Examiner* — Steven B McAllister
*Assistant Examiner* — Steven Anderson, II
(74) *Attorney, Agent, or Firm* — Gunn Lee & Cave, PC

(57) ABSTRACT

A remotely controlled air vent register which allows the direction of airflow to be changed with a rotating assembly driven by a first motor mounted to a duct-side face of the mounting plate and which allows the amount of airflow to be changed with louvers operated by a second motor mounted to a duct-side face of the mounting plate, both of said motors being controlled by a processor with a receiver to receive an activation signal transmitted from a location apart from the vent register.

21 Claims, 8 Drawing Sheets

(56) References Cited

U.S. PATENT DOCUMENTS

| | | | | |
|---|---|---|---|---|
| 2006/0052046 | A1* | 3/2006 | Krause | B60H 1/3421 454/155 |
| 2009/0149123 | A1* | 6/2009 | Blagg | F24F 11/053 454/258 |
| 2009/0149124 | A1* | 6/2009 | Stevenson | B60H 1/00671 454/358 |
| 2011/0034120 | A1* | 2/2011 | Jaiyeola | F24F 11/006 454/335 |
| 2011/0186156 | A1* | 8/2011 | Borander | F16K 7/08 137/561 R |
| 2011/0198404 | A1* | 8/2011 | Dropmann | F24F 11/0034 236/49.3 |
| 2013/0047977 | A1* | 2/2013 | Schmaelzle | F24J 2/38 126/605 |

* cited by examiner

REMOTE CONTROLLED VENT REGISTER

CROSS REFERENCES TO RELATED APPLICATIONS

This is a continuation-in-part application that claims the benefit of and priority to U.S. application Ser. No. 13/644,142, filed on Oct. 3, 2012, which claims the benefit of and priority to U.S. provisional patent Application Ser. No. 61/542,652, filed Oct. 3, 2011, entitled "Remote Controlled Vent Register." Each of these applications is incorporated herein by reference.

STATEMENT REGARDING FEDERALLY SPONSORED RESEARCH OR DEVELOPMENT

Not applicable.

BACKGROUND OF THE INVENTION

1. Technical Field

The present invention generally concerns the heating, ventilation, and air conditioning (HVAC) field. Specifically, it concerns an improved vent register that is remotely adjustable to control the direction of airflow from the register and the amount of airflow through the register.

2. Description of the Related Art

HVAC vent registers come in a variety of shapes and sizes to fit the needs of the HVAC system design and the aesthetic taste of consumers. Regardless of the varied shapes and sizes, most vent registers offer only limited adjustment, if any, for controlling the general direction and amount of air that flows through the louvers on the register.

The general direction of airflow is typically not adjustable. Many registers have one or more groups of louvers aligned in a common general direction. If there are several groups of louvers, the general direction as between each different group may differ. However, the general direction of airflow through each group is established when the register is installed and cannot be changed.

On the other hand, the amount of air that flows through the louvers typically is adjustable but must be manually adjusted at the register by physically moving a lever coupled with hinged louvers. The lever usually extends from the room-side face of the register and when the register is mounted in hard-to-reach places such as, for example, the ceiling of a room, the HVAC user must risk his or her safety by climbing a ladder or other object to reach the lever and adjust the amount of airflow.

BRIEF SUMMARY OF THE INVENTION

The present invention is directed to an improved air vent register that allows a user to remotely control both the general direction of airflow from the register and the amount of airflow through the register. It utilizes a first electric motor to turn a rotating assembly that is rotatably mounted to a mounting plate. The rotating assembly includes one or more louvers that airflows through from the HVAC duct system to condition the room. When the louvers are opened at an angle, the direction of airflow is altered by powering the electric motor to rotate the rotating assembly.

The rotating assembly includes a first ring concentric with a second ring. In one embodiment, the first and second rings are in a stacked configuration on the mounting plate, with the first ring adjacent the mounting plate and the second ring adjacent the first ring. The first ring and the second ring each have a first geared surface facing radially outward. The first geared surface of the first ring is in geared engagement with a first gear driven by the first motor. The first geared surface of the second ring is in geared engagement with a second gear driven by a second motor. The second ring also has a second geared surface facing the first ring. An intermediary gear is between the first and second rings and is in geared engagement with the second geared surface of the second ring.

The second motor rotates the second ring relative to the first ring to open and close the louvers on the rotating assembly. In this regard, the second ring may be rotated at an angular velocity different than that of the first ring, in a direction different than that of the first ring, or both. Rotation of the second ring relative to the first ring causes the intermediary gear between the rings to rotate. The intermediary gear is secured to a louver axle that extends from the intermediary gear toward the interior of the rotating assembly. Within the interior of the rotating assembly the louver axle is secured to an activating linkage. Rotation of the intermediary gear causes the louver axle to rotate and rotation of the louver axle causes the activating linkage to rotate. Rotation of the activating linkage causes other components within the rotating assembly to open and close the louvers, as described hereinbelow.

DETAILED DESCRIPTION OF THE INVENTION

Initially, it should be noted that "static coupling" of one object with another object, as used herein, refers to a relationship between the objects to provide for movement of one object in the same direction as the other object. For example, rotation of a first object that it statically coupled with a second object causes the second object to rotate in the same direction as the first, or, translational movement of the first object in a certain direction causes the second object to move in the same direction as the first. Objects that are statically coupled to each other may be separate pieces directly or indirectly connected to each other or the objects may be a single integral piece. In contrast, pivotal coupling of one object with another object is a relationship between the objects to provide for pivoting movement of the objects relative to each other. Objects that are pivotally coupled to each are separate pieces directly or indirectly connected to each other but not necessarily attached to each other. Further, it should be noted that "geared engagement" or "geared communication" between elements means that the elements have teeth or cogs which are mashed together so that rotation of one element drives the other or vice versa.

Figure 1:
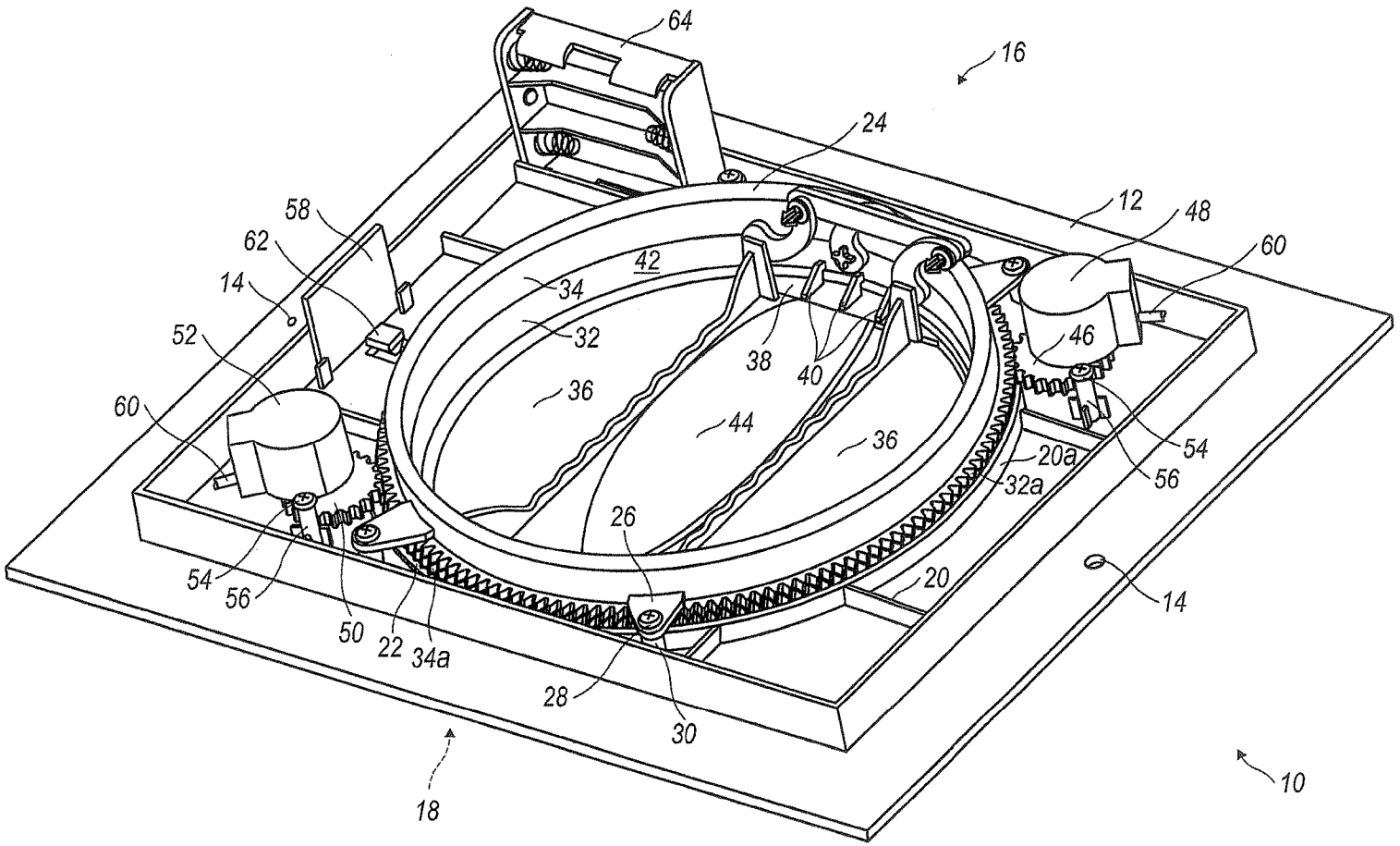
FIG. 1 illustrates a top perspective view of an embodiment of the present invention with a plurality of louvers in a closed position.

Referring to FIG. 1, an embodiment of a vent register 10 of the present invention is shown. The vent registers 10 includes a mounting plate 12 with holes 14 at each end for installing the register 10 on a ceiling, wall, or other structure (not shown). The mounting plate 12 has a duct-side face 16 and a room-side face 18 opposite the duct-side face 16. When the register 10 is installed the room-side face 18 is toward the room that is being conditioned while the duct-side face 16 is toward the air flowing from the HVAC system ducts (not shown).

In this embodiment the duct-side face 16 includes one or more rigid supports 20 extending orthogonally therefrom. The rigid supports help provide structural integrity to the mounting plate 12. A portion 20*a* of the rigid supports 20 surrounds a hole 22 that is defined by the mounting plate 12.

A rotating assembly 24 is rotatably mounted to the mounting plate 12. Mounting the rotating assembly 24 to the mounting plate 12 may be achieved through any manner which allows rotation of the rotating assembly 24 relative to the static mounting plate 12. In this embodiment, mount tabs 26 extend over a position of the rotating assembly 24 and screws 28 threaded into rotating assembly mounts 30 secure the mount tabs 26 to the mounting plate 12. The secured mount tabs 26 prevent displacement of the rotating assembly 24 away from the duct-side face 16 of the mounting plate 12 but still allow the assembly 24 to rotate.

The rotating assembly includes a first ring 32, a second ring 34 concentric with the first ring 32, and a plurality of louvers 36 within the rings 32, 34. The louvers 36 are associated with the hole 22 such that when opened airflow from the HVAC system ducts through the hole 22 may be achieved. Also within the rotating assembly 24 is a first sideplate 38 attached to the first ring 32 with one or more ribs 40 extending from an inner wall 42 of the first ring 32. Additionally, one or more of the louvers 36 may contain a stop 44 extending over one or more of the other louvers 36.

The first ring 32 includes a first geared surface 32*a* in geared engagement with a first gear 46 that is driven by a first motor 48, and, the second ring 34 includes a first geared surface 34*b* in geared engagement with a second gear 50 that is driven by a second motor 52. Both the first motor 48 and the second motor 52 are statically mounted to the mounting plate 12. In this embodiment, the motors 48, 52 are secured to the mounting plate 12 with one or more screws 54 threaded into motor mounts 56 extending from the duct-side face 16 of the mounting plate 12.

Also included on the duct-side face 16 of the mounting plate 12 in this embodiment is a processor 58 that controls the vent register 10. The processor 58 is in communication with the first and second motors 48, 52. The processor 58 may be electrically connected to the motors 48, 52 with wires 60 to establish such communication or may be in communication in some other manner (e.g., wireless, radio frequency, optical, etc.).

The processor 58 may also be in communication with a receiver 62 that is capable of receiving a signal (e.g., wireless, radio frequency, optical, etc.) transmitted toward the room-side face 18 of the mounting plate 12. Communication between the processor 58 and the receiver 62 may be established via an electrical connection or through some other form of communication (e.g., wireless, radio frequency, optical, etc.). Alternatively, the processor 58 may be electrically connected to a wall switch (not shown) through wiring routed within the walls or ceiling of the conditioned structure.

A battery pack 64 is also included on the duct-side face 16 of the mounting plate 12 in this embodiment. Batteries (not shown) within the battery pack 64 provide power the processor 58 and the motors 48, 52, thereby allowing this embodiment of the vent register 10 to be used in a retrofit application. Alternatively, the processor 58 and motors 48, 52 may receive power from a source separated from the vent register 10 such as, for example, if the conditioned structure were wired to provide power to the vent register 10.

Figure 2:
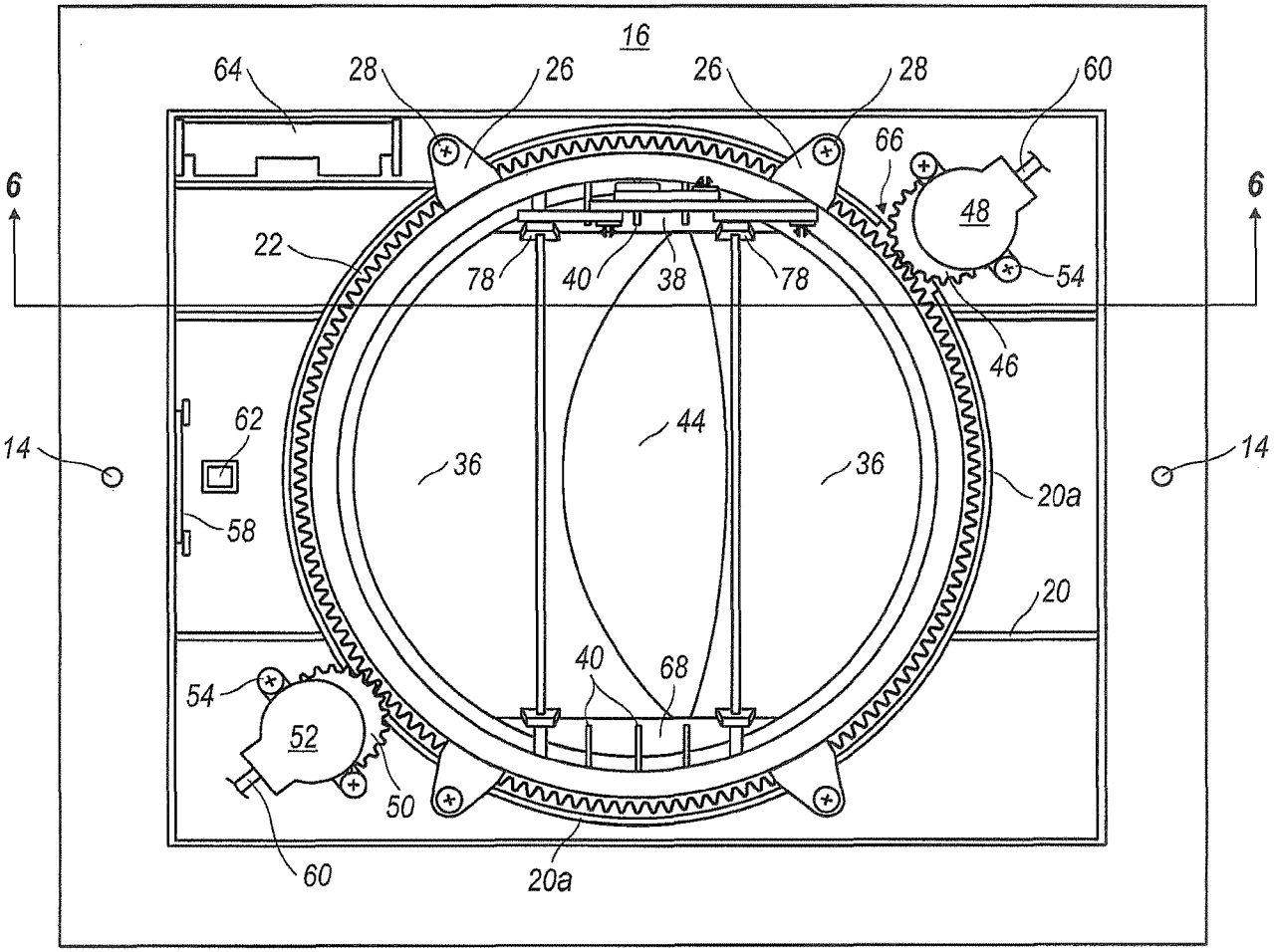
FIG. 2 shows a top plan view of an embodiment of present invention with the plurality of louvers in a closed position.

Referring to FIG. 2, the portion 20*a* of the rigid supports 20 is along the perimeter of the hole 22 and extends over the first geared surface 32*a* of the first ring 32. A break 66 in the portion 20*a* allows geared engagement of the first geared surface 32*a* with the first gear 46 while the second gear 50 driven by the second motor 52 extends over the portion 20*a*. In this embodiment, the hole 22 is defined as a circle centered in the mounting plate 12; however, it may be positioned elsewhere on the mounting plate 12 or may be shaped differently in alternative embodiments.

A second sideplate 68 within the rotating assembly 24 is also shown in FIG. 2. The second sideplate 68 is attached to the first ring 32 opposite the rotating assembly 24 from the first sideplate 38. One or more ribs 40 extend between the first ring 32 and the second sideplate 68. The plurality of louvers 36 is between the first and second sideplates 38, 68; however, more, less, or even no sideplates 38, 68 at all may be present in alternative embodiments.

Figure 3:
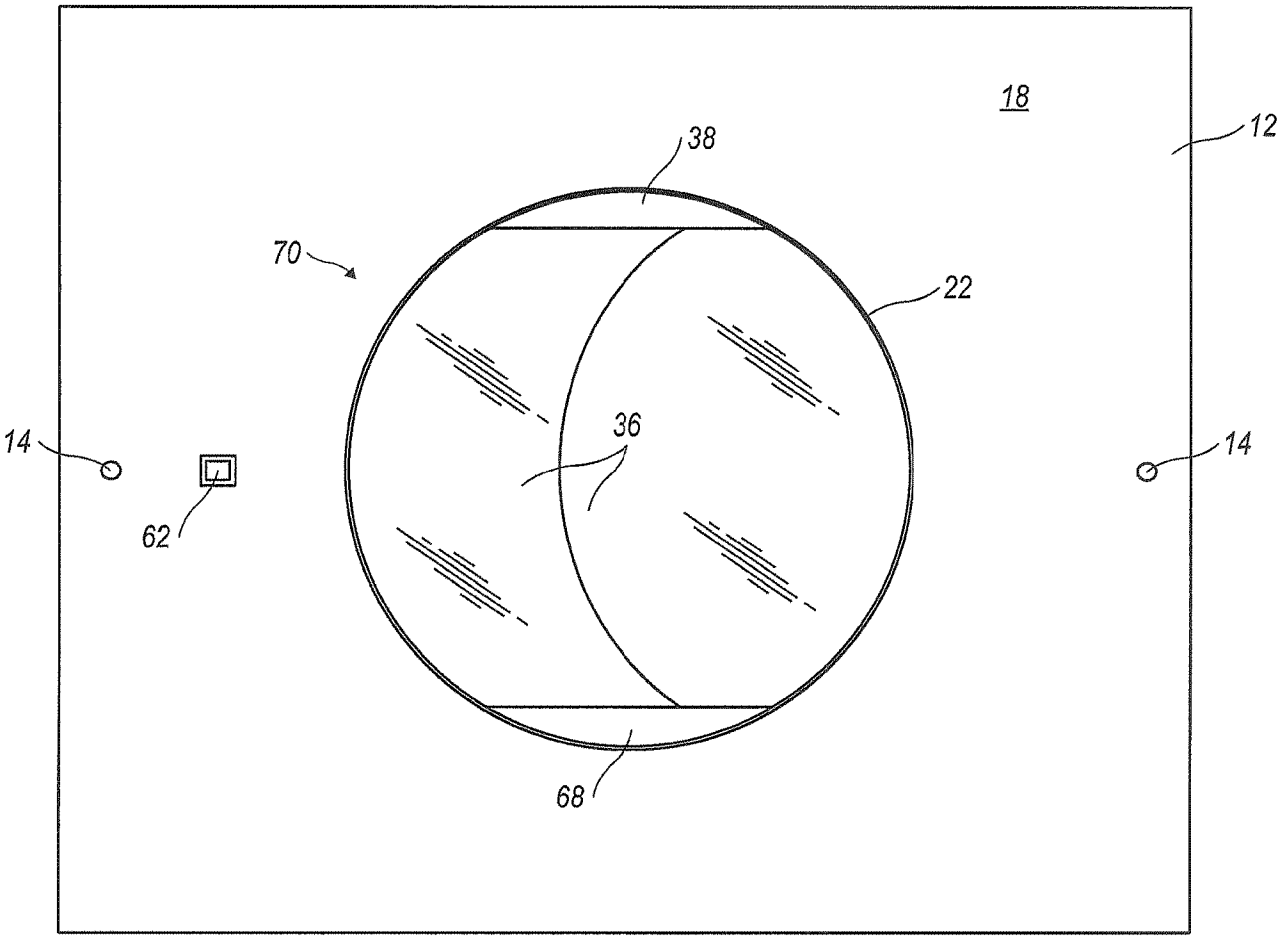
FIG. 3 shows a bottom plan view of an embodiment of present invention with the plurality of louvers in a closed position.

Referring to FIG. 3, the room-side face 18 of the mounting plate 12 is shown with the plurality of louvers 36 in a closed position, between the first and second sideplates 38, 68. Together, the plurality of louvers 36 and the sideplates 38, 68 define a bottom 70 of the rotating assembly 24. The bottom 70 is within the hole 22 such that it is coplanar with the room-side face 18 of the mounting plate 12 when the louvers 36 are closed. Alternatively, the bottom 70 may be defined by a single louver (not shown), defined by more or less sideplates (not shown), may not be along a single plane, and may not be coplanar with the room-side face 18. The receiver 62 is also shown exposed in FIG. 3 so it can receive an optical signal directed toward the room-side face 18 from a remote control (not shown).

Figure 4:
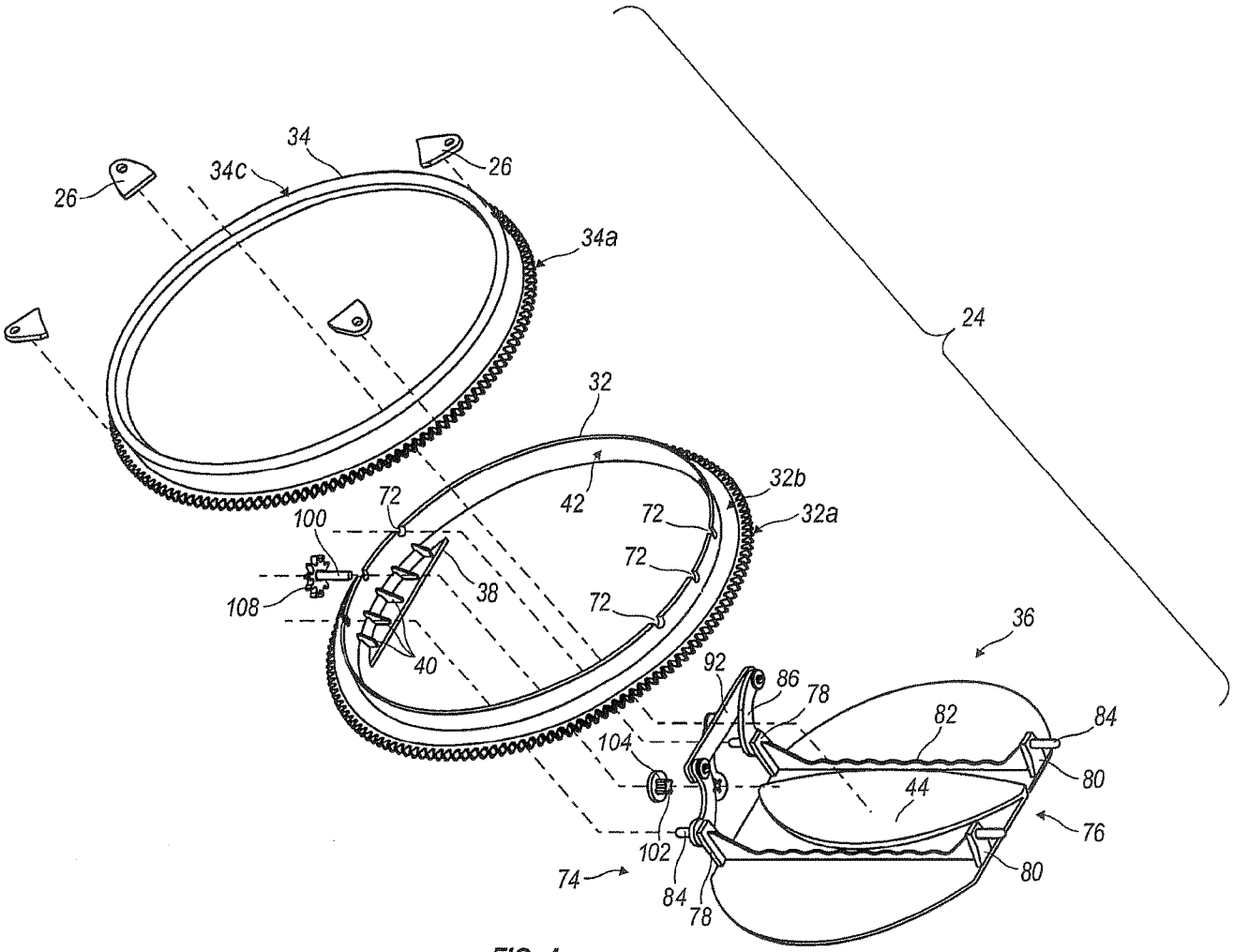
FIG. 4 shows an exploded perspective of a rotating assembly in this embodiment of the present invention.

Referring to FIG. 4, the first and second rings 32, 34 and the plurality of louvers 36 are shown separated from each other, revealing notches 72 in the inner wall 42 of the first ring 32. The first geared surface 32*a*, 34*a* of each ring 32, 34 is disposed around an entire circumference of the rings 32, 34. Although not visible, a second geared surface 34*b* of the second ring 34 is beneath a top surface 34*c* of the second ring 34 and is also disposed around an entire circumference of the second ring 34. The second geared surface 34*b* faces a surface 32*b* along the first ring 32. In alternative embodiments, either or both of the first geared surfaces 32*a*, 34*a* and the second geared surface 34*b* may be disposed around less than an entire circumference.

When the rotating assembly 24 is assembled, each of the louvers 36 has a first end 74 toward the first sideplate 38 and a second end 76 toward the second sideplate 68. A primary common lever 78 extends away from each of the louvers 36 at their first end 74 and a secondary common lever 80 extends away from each of the louvers 36 at their second end 76. A 7support 82 extends between the primary and secondary common levers 78, 80 on each of the louvers 36. The primary common lever 78, the secondary common lever 80, and the support 82 may be formed as a single piece integral with each of the louvers 36 or may be separately manufactured pieces attached to the louvers 36.

Each of the louvers 36 pivots within the rotating assembly 24 to open and close. In this embodiment both the primary and secondary levers 78, 80 include a hinge pin 84 extending toward the inner wall 42 of the first ring 32. Each hinge pin 84 extends through the inner wall 42 and occupies one of the notches 72 in the inner wall 42 of the first ring 32. Alternatively, the hinge pins 84 may extend into other elements on the rotating assembly 24 (e.g., into the second ring 34).

Figure 5:
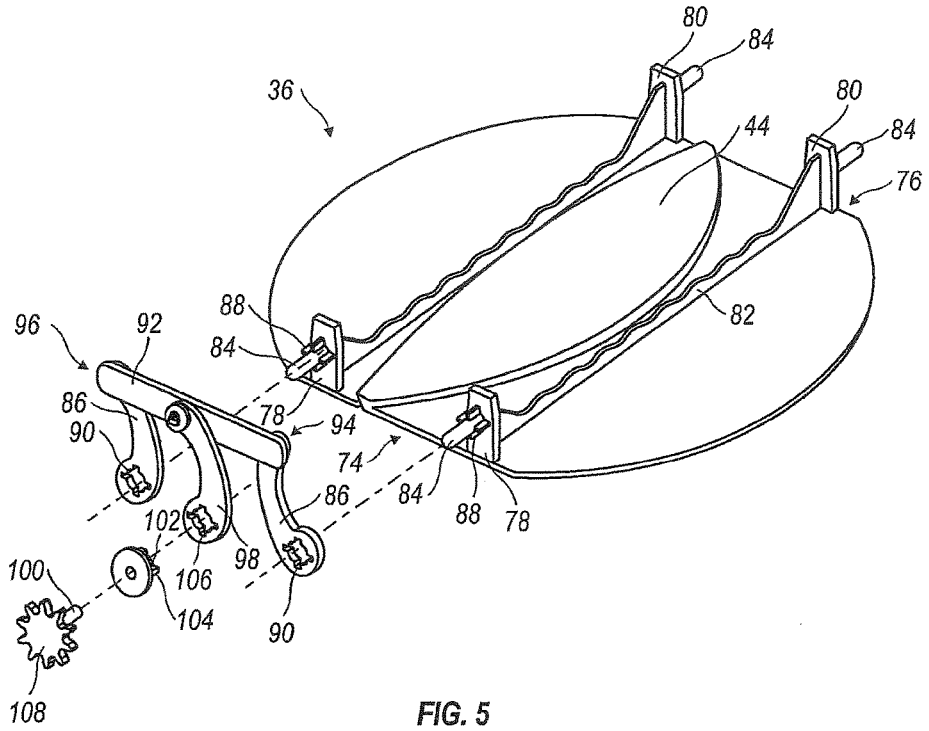
FIG. 5 shows a partially exploded perspective view of the plurality of louvers and various activating components in this embodiment of the present invention.

Referring to FIG. 5, the primary common lever 78 is statically coupled with a louver linkage 86. In this embodiment, the hinge pin 84 includes one or more splines 88 received in corresponding slots 90 in the louver linkage 86 to form a spline joint. Alternatively, a keyed joint with some other geometric shape may be used (e.g., a square prism on the hinge pin 84 with a corresponding square-shaped void on the louver linkage 86). As a further alternative, the louver linkage 86 may be affixed to the primary common lever 78 using an adhesive or a fastener, may be press-fit over the hinge pin 84, or may be integrally formed with the primary common lever 78.

Each louver linkage 86 extends away from its respective hinge pin 84 to a connecting strut 92 and is pivotally coupled with the connecting strut 92. In this embodiment the connecting strut 92 extends between two louver linkages 86 and is pivotally coupled with one louver linkage 86 at one end 94 and pivotally coupled with the other louver linkage 86 at its other end 96. The connecting strut 92, however, may be pivotally coupled with more or less louver linkages 86, depending on the number of louvers 36 present in the rotating assembly 24.

The connecting strut 92 is also pivotally coupled with an activating linkage 98. Preferably, the activating linkage 98 is pivotally coupled with the connecting strut 92 between the two louver linkages 86, however, this coupling could occur elsewhere on the connecting strut 92. For example, a vent register 10 with only a single louver (not shown) may have the connecting strut 92 pivotally coupled with the louver linkage 86 at one end 94 and pivotally coupled with the activating linkage 98 at its other end 96.

The activating linkage 98 extends from the connecting strut 92 to a louver axle 100 and is statically coupled with the louver axle 100. In this embodiment the activating linkage 98 is statically coupled with the louver axle 100 through an object 102 having one or more splines 104 that is press-fit over the louver axle 100. The splines 104 are received in corresponding slots 106 in the activating linkage 98 to create a spline joint. Alternatively, a keyed joint may be used or the activating linkage 98 may be directly adhered to or press-fit over the louver axle 100.

The louver axle 100 extends from the activating linkage 98 to an intermediary gear 108 and is statically coupled with the intermediary gear 108. In this embodiment the intermediary gear 108 is formed as an integral piece with the louver axle 100 and may be manufactured, for example, through injection molding techniques or additive processes like three dimensional printing. Alternatively, the intermediary gear 108 may be press-fit over or affixed to the louver axle 100 with an adhesive or a fastener, or, a spline joint, keyed joint, or another type of torque-transfer joint between the intermediary gear 108 and the louver axle 100 may be utilized. Referring to FIG. 4, the louver axle 100 extends through one of the notches 72 in the inner wall 42 of the first ring 32.

Figure 6:
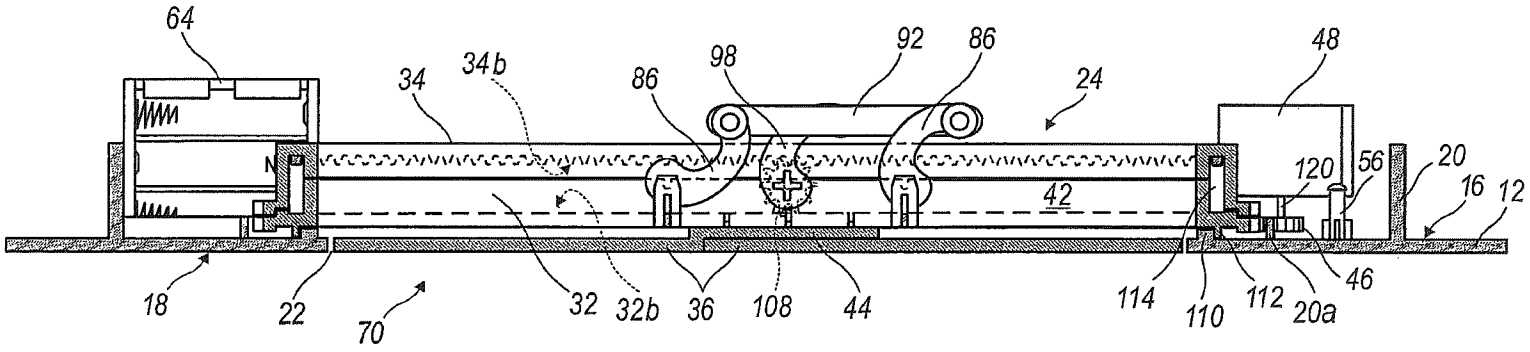
FIG. 6 is a cross-sectional side view taken along section line 6-6 in FIG. 2.

Referring to FIG. 6, the first and second rings 32, 34 of the rotating assembly 24 are in a stacked configuration with the second ring 34 adjacent the first ring 32 and the first ring 32 adjacent the duct-side face 16 of the mounting plate 12. A lip 110 extends from the duct-side face 16 of the mounting plate 12 around the hole 22 and a corresponding lip 112 extends from the first ring 32 radially outward of the lip 110. Though not shown, one or more bearings may be between the first ring 32 and the mounting plate 12. The bottom 70 of the rotating assembly 24 is coplanar with the room-side face 18 of the mounting plate 12 with the plurality of louvers 36 closed, and, the stop 44 extends over one of the louvers 36.

Figure 7:
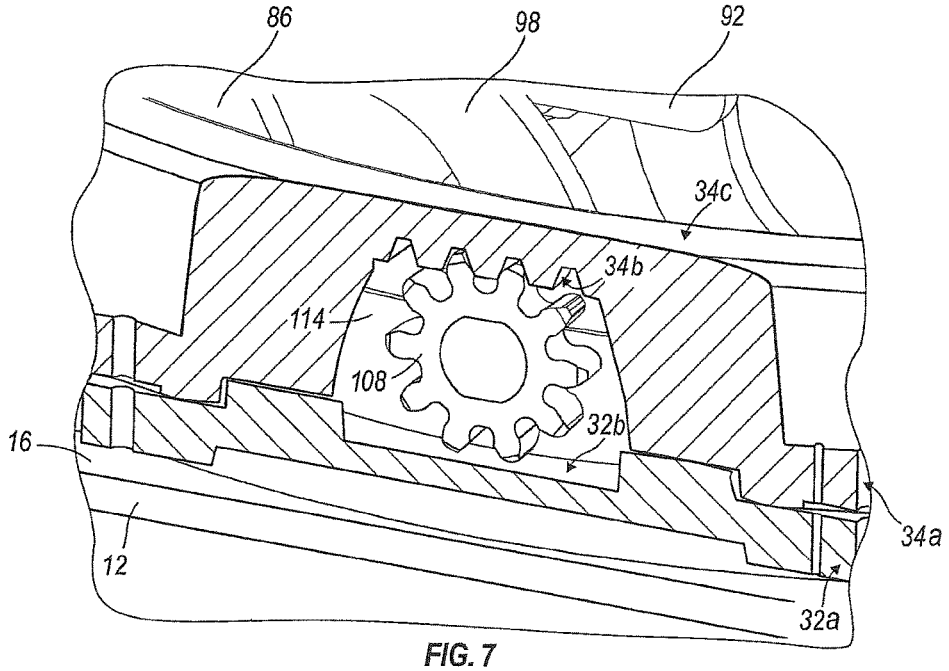
FIG. 7 is a cutaway cross-sectional view of the first and second rings, showing an intermediary gear between the rings and in geared engagement with a second geared surface disposed on the second ring.
Figure 8:
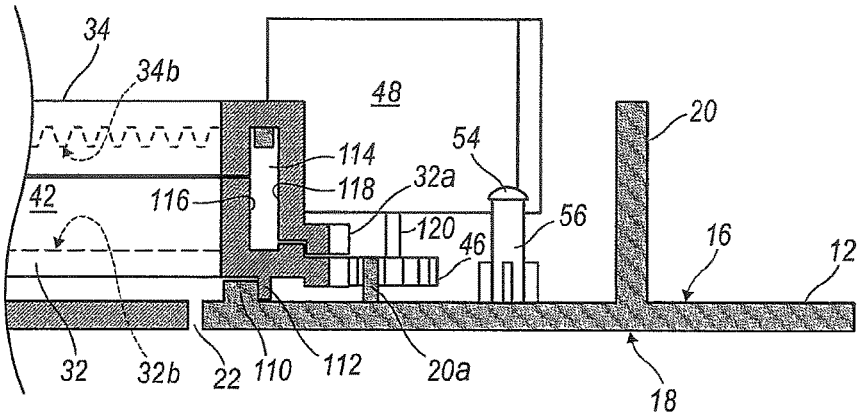
FIG. 8 is a close-up of a portion of the cross-sectional view shown in FIG. 6.

In the rotating assembly 24, the second geared surface 34*b* of the second ring 34 faces the surface 32*b* along the first ring 32. The intermediary gear 108 is between the second geared surface 34*b* of the second ring 34 and the surface 32*a* of the first ring 32, as shown in FIG. 7. The intermediary gear 108 is in geared engagement with the second geared surface 34*b* and is within a cavity 114 between the first and second rings 32, 34. FIG. 8 shows the cavity 114 is formed by an inner cavity wall 116 radially inward of the surface 32*b* of the first ring 32 and an outer cavity wall 118 radially outward of the second geared surface 34*b* of the second ring 34. The cavity 114, however, may be any enclosed space between the two rings 32, 34 occupied by the intermediary gear 108. Alternatively, the cavity 114 may not be present in other embodiments.

Also shown in FIG. 8 is a drive shaft 120 extending from the first motor 48 to the first gear 46. The first gear 46 is behind the portion 20*a* of the rigid supports 20 and is in geared engagement with the first ring 32.

To operate the vent register 10 the receiver 62 receives a signal that is communicated to the processor 58. The processor 58 activates the first motor 48, the second motor 52, or both, depending on the nature of the signal. The nature of the signal dictates the desired operation of the vent register 10. For example, the signal may be one to rotate the rotating assembly 24 to change the direction of airflow from the register 10.

To rotate the rotating assembly 24, the processor 58 activates the first motor 48 to rotate the drive shaft 120 and the first gear 46. Rotation of the first gear 46 causes the rotating assembly 24 to rotate due to the geared engagement of the first gear 46 with the first geared surface 32*a* of the first ring 32. As the rotating assembly 24 rotates, the lip 112 extending from the first ring 32 displaces along the lip 110 extending from the duct-side face 16 of the mounting plate 12. The lip 110 prevents the first ring 32 from lateral movement across the duct-side face 16 of the mounting plate 12. Optimally, the rotating assembly 24 can rotate at least a full 360° when driven by the first motor 48, however, the processor 58 may be programmed to limit the rotation in alternative embodiments.

Figure 9:
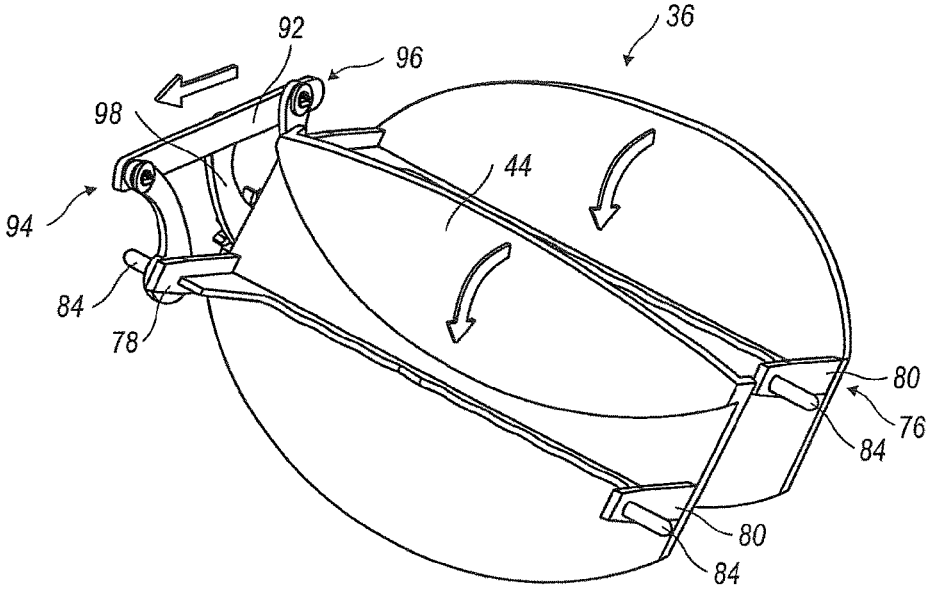
FIG. 9 is a perspective view of the plurality of louvers and various activating components in this embodiment of the present invention, with arrows indicating movement toward an open position for the louvers.

Activation of the second motor 52 is also controlled by the processor 58 once the appropriate signal is received. After receiving the appropriate signal, the processor 58 instructs the second motor 52 to rotate its drive shaft (not shown)

which in turn rotates the second gear 50. The geared communication of the second gear 50 with the first geared surface 34*b* of the second ring 34 causes the second ring 34 to rotate. Rotation of the second ring 34 causes the intermediary gear 108 to rotate, which causes the louver axle 100 to rotate. Rotation of the louver axle 100 causes the activating linkage 98 to rotate about louver axle 100. Rotation of the activating linkage 98 causes it to exert a translational force on the connecting strut 92 at the pivotal coupling of the activating linkage 98 and connecting strut 92. The pivotal coupling allows the connecting strut 92 to undergo translational movement as shown in FIG. 9. Translational movement of the connecting strut 92 causes pushing or pulling of the louver linkages 98 at the pivotal coupling of the louver linkages 98 with the connecting strut 92. Pushing or pulling the louver linkages 98 causes them to act as a moment arm, rotating their respective primary common lever 78 about the respective hinge pin 84.

Rotation of each primary common lever 78 about its respective hinge pin 84 causes each of the louvers 36 to pivot within the rotating assembly 24. Pivoting of the louvers 36 occurs about the hinge pin 84 in the respective notch 72 in the inner wall 42 of the first ring 32. Pivoting of the louvers 36 occurs until the processor 58 interrupts power to the second motor 52, or, until the louvers 74 are physically prevented from further rotation. As an example of the latter, the louvers 36 will not rotate past closed because the stop 44 prevents the louvers 36 from pivoting beyond a certain position. Preferably, the processor 58 monitors current flow to the first and second motors 48, 52 and interrupts power to the motors 48, 52 to prevent them from burning out. For example, once physical contact of the louvers 36 with the stop 44 occurs, the processor 58 may detect a spike in electrical current and interrupt power to the motors 48, 52 as a result.

Figure 10:
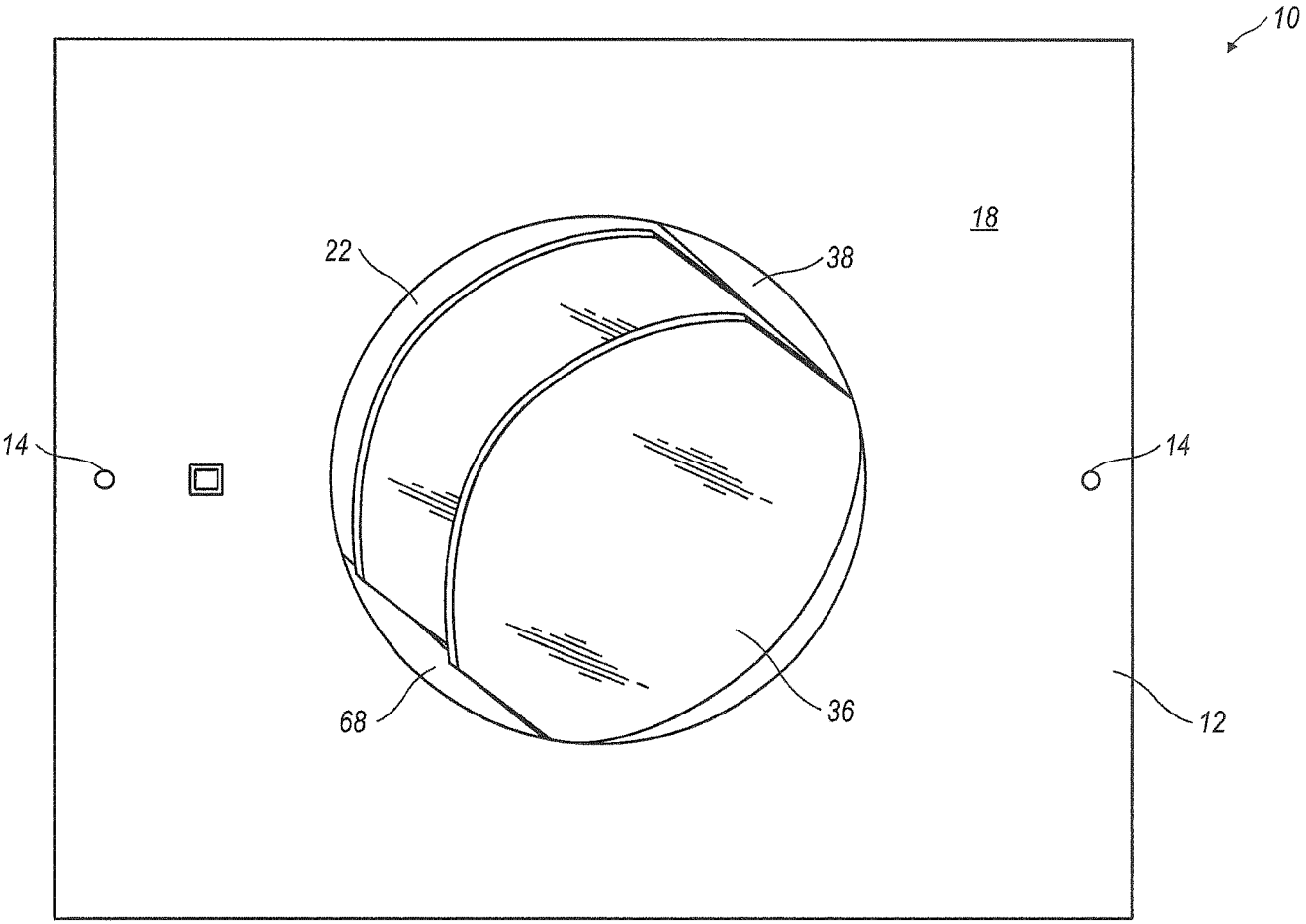
FIG. 10 shows a bottom plan view of this embodiment of present invention with plurality of louvers in an open position and the rotating assembly in a rotated position as compared to that shown in FIG. 3.

Referring to FIG. 10, the rotating assembly 24 is in a rotated position as compared to FIG. 3. Additionally, the plurality of louvers 36 is in an opened position and the direction of airflow from the louvers 36 is in a direction different from the direction of airflow if the louvers 36 were opened in FIG. 3.

Although the present invention has been described with reference to specific embodiments, this description is not meant to be construed in a limiting sense. Various modifications of the disclosed embodiments, as well as alternative embodiments of the invention will become apparent to persons skilled in the art upon the reference to the above description of the invention. It is, therefore, contemplated that the appended claims will cover such modifications that fall within the scope of the invention.

We claim:

1. A remote controlled air vent register comprising:

a mounting plate having a duct-side face, a room-side face, and a hole extending between the duct-side and room-side faces;

a rotating assembly rotatably mounted to the mounting plate, said rotating assembly comprising:

a ring with an inner wall and an outer wall, said outer wall at least partially forming a circumference;

a lip extending from said outer wall, said lip having a portion adjacent the duct-side face;

a geared surface disposed on the lip, said geared surface extending at least partially around the circumference;

a first sideplate and a second sideplate extending from the inner wall; and at least one louver positioned between the sideplates, said at least one louver being radially inward of the inner wall;

a motor mounted to the duct-side face of said mounting plate, said motor having a drive shaft;

a gear statically coupled with the drive shaft, said gear being in geared communication with the geared surface; and, a processor communicated with the motor, said processor being configured to receive a signal transmitted from a location remote of the air vent register.

2. A remote controlled air vent register comprising:

a mounting plate having a duct-side face, a room-side face, and a hole extending between the duct-side and room-side faces;

a rotating assembly rotatably mounted to the mounting plate, said rotating assembly comprising:

a first ring having an outer circumferential wall and an inner wall, said outer circumferential wall having a first geared surface extending at least partially around said outer circumferential wall of said first ring;

a second ring concentric with said first ring, said second ring having an outer circumferential wall with a first geared surface extending at least partially around said outer circumferential wall of said second ring, and said second ring having a second geared surface extending circumferentially at least partially along a surface that faces the first ring;

an intermediary gear between the first and second rings, said intermediary gear being in geared engagement with the second geared surface of said second ring;

a first sideplate and a second sideplate attached to the inner wall of the first ring; and at least one louver pivotally mounted within said first and second rings, said at least one louver positioned between said first and second sideplates;

a first motor mounted to the mounting plate, said first motor having a drive shaft extending to a first gear, said first gear being in geared engagement with the first geared surface of the first ring;

a second motor mounted to the mounting plate, said second motor having a drive shaft extending to a second gear, said second gear being in geared engagement with the first geared surface of the second ring; and a processor communicated with the first and second motors, said processor being configured to receive a signal transmitted from a location remote of the air vent register.

3. The remote controlled air vent register as recited in claim 2 further comprising a wireless receiver in communication with the processor, and wherein the signal is a wireless signal communicated to the processor through the wireless receiver.

4. The remote controlled air vent register as recited in claim 2 wherein the first and second sideplates are co-planar with the at least one louver when said at least one louver is in a closed position.

5. The remote controlled air vent register as recited in claim 2 wherein the first geared surface of the first ring faces a radially outward direction.

6. The remote controlled air vent register as recited in claim 5 wherein the first geared surface of the second ring faces a radially outward direction.

7. The remote controlled air vent register as recited in claim 2 wherein the rotating assembly further comprises:

a louver axle statically coupled with the intermediary gear and extending from said intermediary gear to within the first and second rings;

an activating linkage statically coupled with the louver axle and extending away from said louver axle;

a connecting strut pivotally coupled with the activating linkage at a distance away from the louver axle;

at least one louver linkage pivotally coupled with the connecting strut and extending away from said connecting strut; and, a primary common lever statically coupled to the at least one louver linkage at a distance away from the connecting strut, said primary common lever extending from the at least one louver.

8. The remote controlled air vent register as recited in claim 7 wherein the at least one louver linkage is a plurality of louver linkages and the at least one louver is a plurality of louvers, and wherein each of said louver linkages is statically coupled with a single primary common lever extending from a single louver within said plurality of louvers.

9. The remote controlled air vent register as recited in claim 2 wherein the intermediary gear is within a cavity between said first and second rings.

10. The remote controlled air vent register as recited in claim 7 wherein the at least one louver is pivotally coupled to the first ring.

11. The remote controlled air vent register as recited in claim 10 wherein the louver axle extends through the inner wall of the first ring.

12. The remote controlled air vent register as recited in claim 11 further comprising at least one pair of notches disposed within the inner wall of the first ring and wherein one of said notches in said pair pivotally supports a hinge pin extending from a primary common lever on the at least one louver and the other of said notches in said pair pivotally supports a hinge pin extending from a secondary common lever on the at least one louver.

13. The remote controlled air vent register as recited in claim 2 wherein the at least one louver has a first end and a second end and, wherein said vent register further comprises a primary common lever extending from said first end and a secondary common lever extending from said second end, each of said common levers having a hinge pin extending into the inner wall of the first ring.

14. The remote controlled air vent register as recited in claim 1 further comprising a wireless receiver in communication with the processor, and wherein the signal is a wireless signal communicated to the processor through the wireless receiver.

15. The remote controlled air vent register as recited in claim 1 wherein the geared surface faces a radially outward direction.

16. The remote controlled air vent register as recited in claim 1 wherein the geared surface is the radially outermost surface of the ring.

17. The remote controlled air vent register as recited in claim 2 wherein the first geared surface of the first ring is the radially outermost surface of the ring.

18. The remote controlled air vent register as recited in claim 2 wherein the first geared surface of the second ring is the radially outermost surface of the ring.

19. A remote controlled air vent register comprising:

a mounting plate having a duct-side face, a room-side face, and a hole extending between the duct-side and room-side faces;

a rotating assembly rotatably mounted to the mounting plate, said rotating assembly comprising:

a first ring having an outer circumferential wall and an inner wall, said outer circumferential wall having a first geared surface extending at least partially around said outer circumferential wall of said first ring;

a second ring concentric with said first ring, said second ring having an outer circumferential wall with a first geared surface extending at least partially around said outer circumferential wall of said second ring, and said second ring having a second geared surface extending circumferentially at least partially along a surface that faces the first ring;

an intermediary gear between the first and second rings, said intermediary gear being in geared engagement with the second geared surface of said second ring;

at least one louver pivotally mounted within said first and second rings;

a louver axle statically coupled with the intermediary gear and extending from said intermediary gear to within the first and second rings;

an activating linkage statically coupled with the louver axle and extending away from said louver axle;

a connecting strut pivotally coupled with the activating linkage at a distance away from the louver axle;

at least one louver linkage pivotally coupled with the connecting strut and extending away from said connecting strut; and a primary common lever statically coupled to the at least one louver linkage at a distance away from the connecting strut, said primary common lever extending from the at least one louver;

a first motor mounted to the mounting plate, said first motor having a drive shaft extending to a first gear, said first gear being in geared engagement with the first geared surface of the first ring;

a second motor mounted to the mounting plate, said second motor having a drive shaft extending to a second gear, said second gear being in geared engagement with the first geared surface of the second ring; and a processor communicated with the first and second motors, said processor being configured to receive a signal transmitted from a location remote of the air vent register.

20. The remote controlled air vent register as recited in claim 19 wherein the first geared surface of the first ring is the radially outermost surface of the ring.

21. The remote controlled air vent register as recited in claim 19 wherein the first geared surface of the second ring is the radially outermost surface of the ring.

* * * * *